US006225957B1

(12) United States Patent
Yamaguchi

(10) Patent No.: US 6,225,957 B1
(45) Date of Patent: May 1, 2001

(54) ANTENNA APPARATUS

(75) Inventor: Yuu Yamaguchi, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/533,243

(22) Filed: Mar. 22, 2000

(30) Foreign Application Priority Data

Mar. 24, 1999 (JP) ..... 11-079026

(51) Int. Cl.[7] ..... H01Q 19/13
(52) U.S. Cl. ..... 343/755; 343/781 P
(58) Field of Search ..... 343/755, 753, 343/781 P, 781 CA, 837, 841; H01Q 19/10, 19/13

(56) References Cited

U.S. PATENT DOCUMENTS

| | | | | |
|---|---|---|---|---|
| 2,939,142 | * | 5/1960 | Fernsler | 343/755 |
| 3,763,493 | * | 10/1973 | Shimada et al. | 343/755 |
| 4,218,683 | | 8/1980 | Hemming | 343/703 |
| 5,929,819 | | 7/1999 | Grinberg | 343/754 |

FOREIGN PATENT DOCUMENTS 0 510 588 A1 10/1992 (EP) .

OTHER PUBLICATIONS

English Abstract of JP 11–340730, published Dec. 10, 1999.

English Abstract of JP 60–85773, published Mar. 25, 1994.

English Abstrac of JP 3–199990, published Aug. 30, 1991.

* cited by examiner

*Primary Examiner*—Michael C. Wimer
(74) *Attorney, Agent, or Firm*—Sughrue, Mion, Zinn, Macpeak & Seas, PLLC

(57) ABSTRACT

A dielectric refractor, a refractive index of which varies in accordance with a frequency, is situated between a primary horn serving as a electric wave source and a concave sub-reflector. A desired transmitting wave in the desired transmitting frequency band is refracted by the dielectric refractor so as to illuminate the sub-reflector. An undesired transmitting wave outside the desired transmitting frequency band is refracted by the dielectric refractor so as to pass along a path for the undesired wave, and reaches a electric wave-absorber to be absorbed thereby. Accordingly, the undesired transmitting wave does not reach the sub-reflector, and is prevented from being radiated to the outside of the antenna apparatus via the sub-reflector and the main reflector.

6 Claims, 4 Drawing Sheets

7A, 7B : PATH OF TRANSMITTING WAVE 7A, 7B : PATH OF TRANSMITTING WAVE

ANTENNA APPARATUS

FIELD OF THE INVENTION

The invention relates to an antenna apparatus, and especially to an antenna apparatus provided with a primary horn, a sub-reflector, and a main refractor.

BACKGROUND OF THE INVENTION

FIG. 1 shows a conventional antenna apparatus. As shown in FIG. 1, the sub-reflector 2 is situated on a principal axis of the main reflector 1 opposite to the same, and the primary horn 3 is situated between the sub-reflector 2 and the main reflector 1.

In case that an electric wave is transmitted by the antenna apparatus shown in FIG. 1, a transmitting power is supplied to the primary horn 3 from a transmitter (not shown). The electric wave radiated from the primary horn 3 illuminates the sub-reflector 2, and is reflected thereby to the main reflector 1. The electric wave reflected by the sub-reflector 2 is again reflected by the main reflector 1, converted into a parallel beam, and transmitted to a receiving antenna apparatus passing along a path 13A to 13B for the transmitting wave.

However, according to the aforementioned conventional antenna apparatus, both the desired and undesired waves are reflected by the sub-reflector 2 and the main reflector 1, and radiated to the outside passing along the path 13A to 13B for the transmitting wave. Accordingly, the undesired wave is radiated to the outside of the antenna apparatus also.

SUMMARY OF THE INVENTION

Accordingly, it is an object of the invention to provide a transmitting antenna apparatus in which an undesired transmitting wave involved in an electric wave radiated from a primary horn is suppressed.

It is a further object of the invention to provide a receiving antenna apparatus in which an interference wave involved in an electric wave received via a main reflector and a sub-reflector is suppressed.

According to the first feature of the invention, an antenna apparatus having a primary horn serving as an output source of an electric wave, a main reflector formed of a parabolic mirror for radiating the electric wave as a parallel beam in a predetermined direction, and a sub-reflector for reflecting the electric wave radiated from the primary horn to the main reflector, comprises:

- a dielectric refractor which refracts the electric waves radiated from the primary horn so that an desired wave in a desired frequency band illuminates the sub-reflector, and an undesired wave outside the desired frequency band does not illuminate the sub-reflector, and
- electric wave-absorbers which are situated near an outer periphery of the sub-reflector, and absorb the undesired refracted wave outside the desired frequency band.

According to the aforementioned structure, although the electric waves radiated from the primary horn involve an undesired transmitting wave outside the desired frequency band as well as a desired transmitting wave, the dielectric refractor refracts the electric waves incident thereon so that the electric waves outside the desired frequency band reaches the electric wave absorbers situated near the outer periphery of the sub-reflector 2, and only the electric wave in the desired frequently band reaches the sub-reflector 2. The sub-reflector 2 reflects only the electric wave in the desired frequency band to the main reflector, and the undesired transmitting wave is not reflected thereto. Accordingly, the undesired transmitting wave involved in the electric waves radiated from the primary horn can be suppressed.

According to the second feature of the invention, an antenna apparatus having a main reflector formed of a parabolic mirror for receiving an electric wave propagated from a transmitting source, a sub-reflector for reflecting the electric wave reflected by the main reflector in a predetermined direction and a primary horn for receiving the electric wave reflected by the sub-reflector, comprises:

- a dielectric refractor which refracts the electric waves reflected by the sub-reflector so that an desired wave in a desired frequency band illuminates an aperture of the primary horn, and an interference wave outside the desired frequency band does not illuminate the aperture of the primary horn, and
- electric wave-absorbers which are situated near an outer periphery of the primary horn and absorb the interference wave outside the desired frequency band refracted by the refractor.

According to the aforementioned structure, although an interference wave is involved in the electric waves received via the main reflector and the sub-reflector, since the refractive index of the dielectric refractor varies in accordance with a frequency, only the desired receiving wave in the desired frequency band reaches the primary horn, and the interference wave outside the desired receiving frequency band reaches the electric wave-absorbers to be absorbed thereby. Accordingly, even in case that the interference wave is involved in the electric waves received via the main reflector and the sub-reflector, the interference wave can be suppressed and an undesirable influence on the desired receiving wave can be reduced.

BRIEF DESCRIPTION ON APPENDED DRAWINGS

The invention will be explained in more detail in conjunction with appended drawings, wherein.

Hereafter, embodiments of an antenna apparatus according to the invention will be explained referring to appended drawings,

[The first preferred embodiment]

Figure 1:
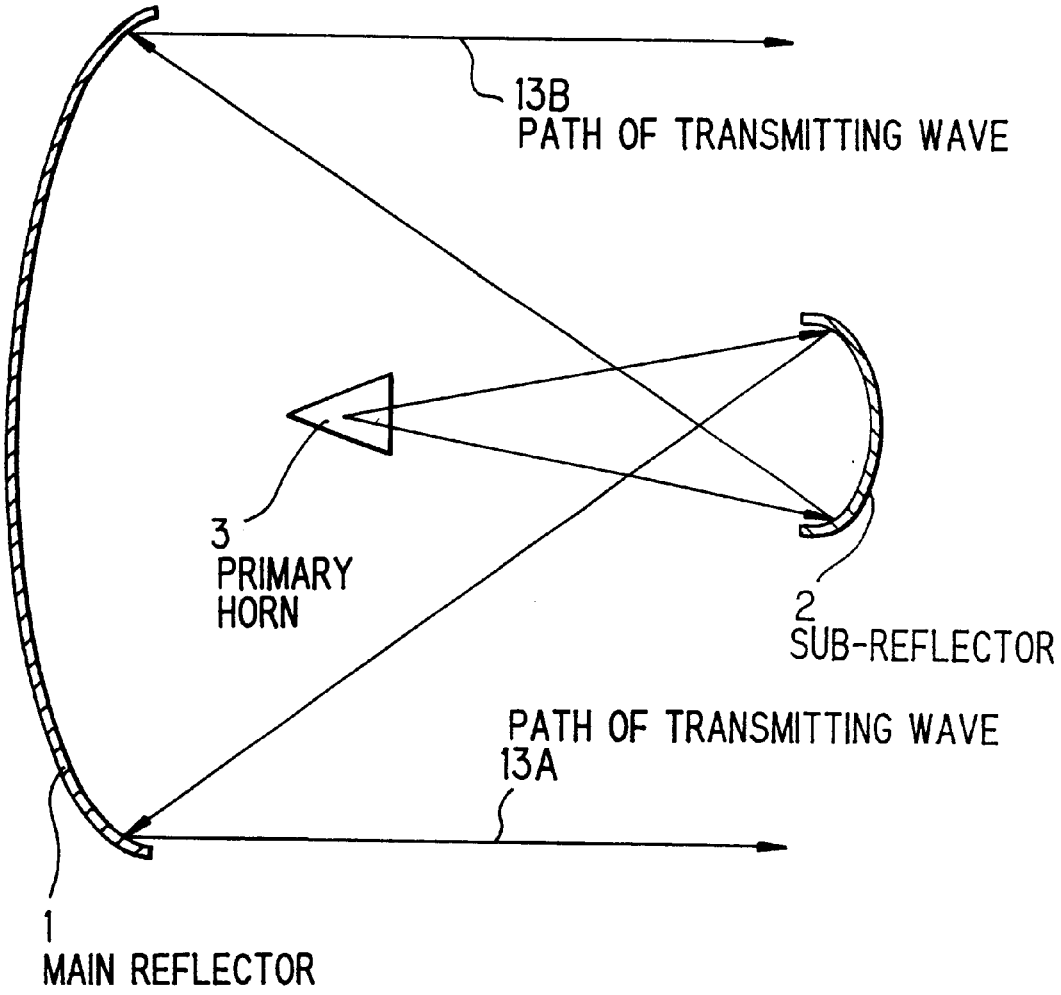
FIG. 1 PRIOR ART
FIG. 1 shows a conventional antenna apparatus.

FIG. 1 shows antenna apparatus according to the first preferred embodiment of the invention. Hereafter, a Gregorian reflector antenna will be explained as an example. A sub-reflector 2 formed of a concave mirror is situated at a predetermined position on a principal axis of a main reflector 1 formed of a parabolic mirror so that the sub-reflector 2 is opposite to the main reflector 1, and a primary horn is situated between the main reflector 1 and the sub-reflector 2. The primary horn 3 is situated under the principal axis of the main reflector 1, and inclines to upside by a predetermined angle. A dielectric refractor 4 is situated on a path of a beam radiated from the primary horn 3, and the sub-reflector 2 is situated on a path of a refracted beam from the dielectric refractor 4. Electric wave-absorbers 5, 6 are respectively provided for an outer periphery of the sub-reflector 2 at upper and lower parts thereof.

A refractive index of dielectric material constituting the dielectric refractor 4 is a function of a frequency, and the dielectric refractor 4 takes advantage of this property.

Dielectric material of a ceramics series is used as material of the dielectric refractor 4 for instance. The dielectric refractor 4 is shaped like a prism with a triangular cross-section. The positions and the attitudes of the primary horn 3 and the dielectric refractor 4 relative to the sub-reflector 2 are adjusted in consideration of the refractive index of the dielectric refractor 4 for a desired frequency in a transmitting frequency band so that the sub-refractor 2 is illuminated by the desired transmitting wave.

The electric wave-absorber 5, 6 are constituted of conductive absorption material formed of resistive wire grids etc., dielectric absorption material formed of rubber or foam styrole containing carbon, or magnetic absorption material formed of composite ferrite or ferrite tiles.

Figure 2:
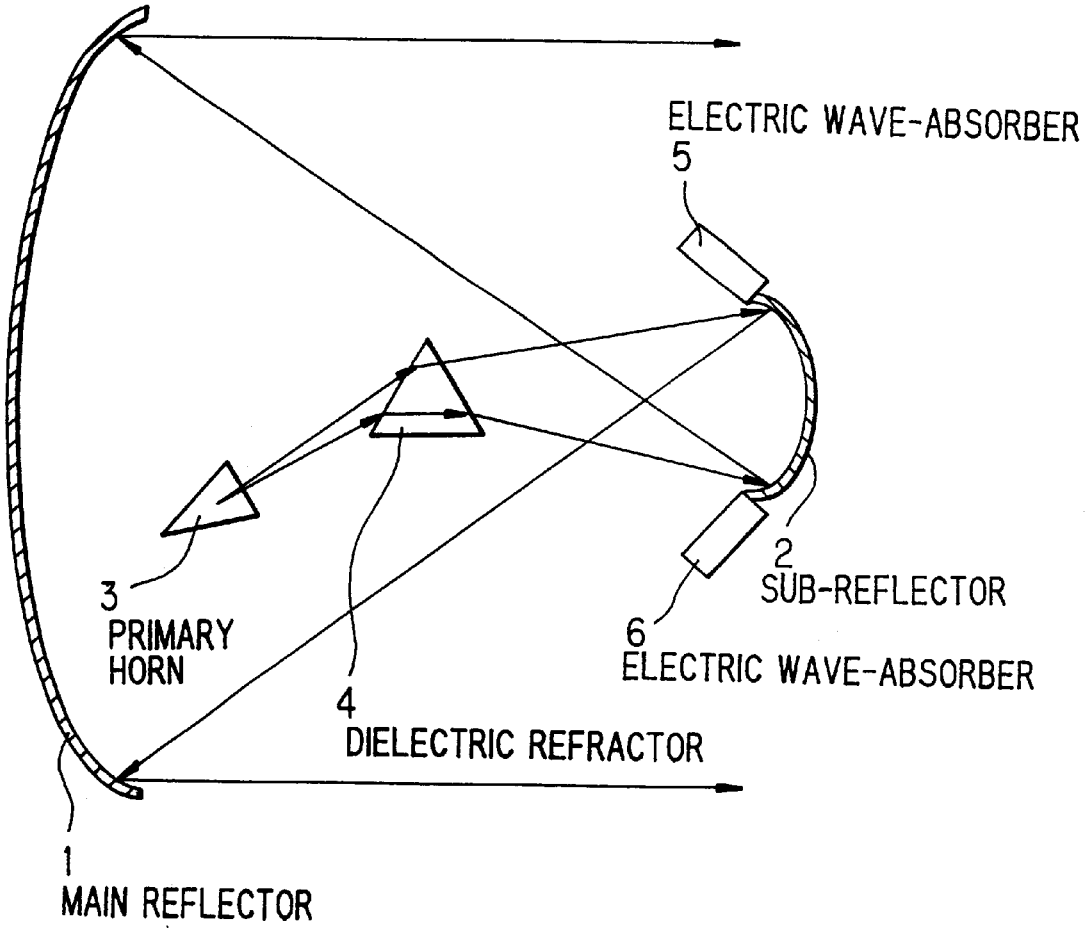
FIG. 2 shows an antenna apparatus according to the first preferred embodiment of the invention.

In FIG. 2, the electric wave radiated from the primary horn 3 reaches the dielectric refractor 4. Although the dielectric refractor 4 is illuminated by the desired transmitting wave in a desired frequency band and the undesired wave outside the desired frequency band, since a refraction angle of the dielectric refractor 4 varies depending on the frequency of the incident wave because of dispersion of a refractive index of the refractor 4, the undesired wave is refracted to the electric wave-absorber 5 or 6 situated near the outer periphery of the sub-reflector 2. Since the electric wave incident on the electric-wave absorber 5 or 6 is not reflected but absorbed thereby, the undesired wave incident on the electric wave-absorber 5 or 6 is not radiated to the outside of the antenna. The sub-reflector 2 reflects only the desired wave incident thereon to the main reflector 1. The transmitting wave reflected by the main reflector 1 is radiated to the outside of the antenna.

Figure 3:
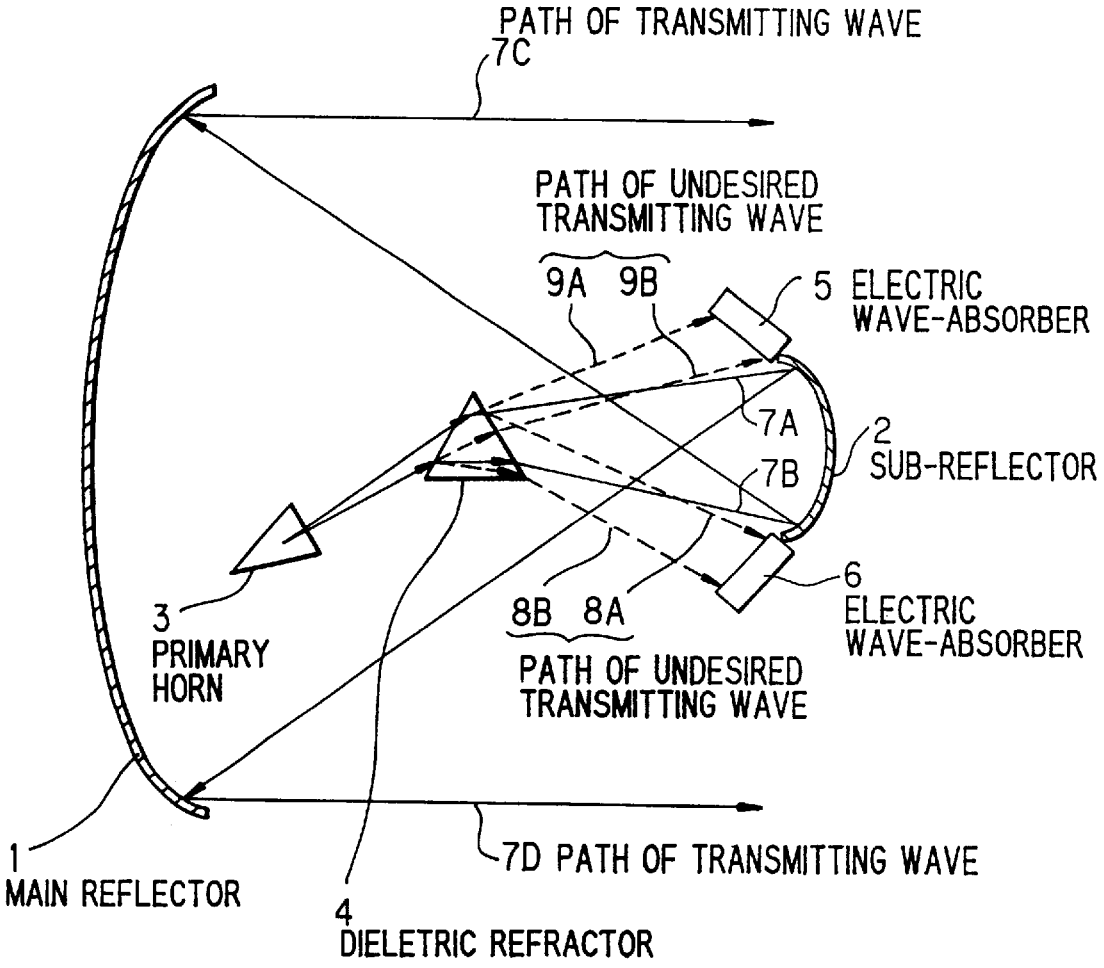
FIG. 3 is an illustration for explaining an operation of an antenna apparatus shown in FIG. 2.

FIG. 3 explains the function of the antenna apparatus shown in FIG. 2. The positions and the attitudes of the primary horn 3 and the dielectric refractor 4 relative to the sub-reflector 2 are adjusted in consideration of the refractive index of the dielectric refractor 4 in the frequency band of the desired transmitting wave so that the sub-refractor 2 is illuminated by the desired transmitting wave. Accordingly, the electric wave in the desired transmitting frequency band radiated from the primary horn 3 passes along a path 7A to 7B for the desired transmitting wave, reaches the sub-reflector 2 to be reflected thereby, reaches the main-reflector 1 to be reflected thereby, and is radiated to the outer space along paths 7C to 7D for the desired transmitting wave.

On the other hand, in case that an electric wave with a frequency higher than that in the desired transmitting frequency band (an undesired wave) is radiated from the primary horn 3, since the refractive index of the dielectric refractor 4 is larger than that for the desired transmitting frequency band, the undesired wave refracted by the dielectric refractor 4 passes along a path 8A to 8B directed to a region under the outer periphery of the sub reflector 2, and reaches the electric wave-absorber 6 situated under the sub-refractor 2. Since the electric wave-absorber 6 does not reflects the electric wave incident thereon, the undesired wave having passed through the path 8A to 8B for the undesired transmitting wave is not radiated to the outside of the antenna apparatus. Similarly, in case that an electric wave with a frequency lower than that in the desired transmitting frequency band (an undesired wave)is radiated from the primary horn 3, since the refractive index of the dielectric refractor 4 is smaller than that for the desired transmitting frequency band, the undesired wave refracted by the dielectric refractor 4 passes along a path 9A to 9B directed to a region over the outer periphery of the sub-reflector 2, and reaches the electric wave-absorber 5. Accordingly, the undesired wave with the lower frequency is not radiated to the outside of the antenna apparatus.

As mentioned in the above, according to the antenna apparatus according to the invention, since only the electric wave in the desired transmitting frequency band reaches the sub-refractor 2 and the undesired wave is aborted by the electric wave-absorber 5 or 6, the radiation of the undesired transmitting wave can be suppressed.

[The second preferred embodiment]

Next, the second preferred embodiment of the invention will be explained.

Figure 4:
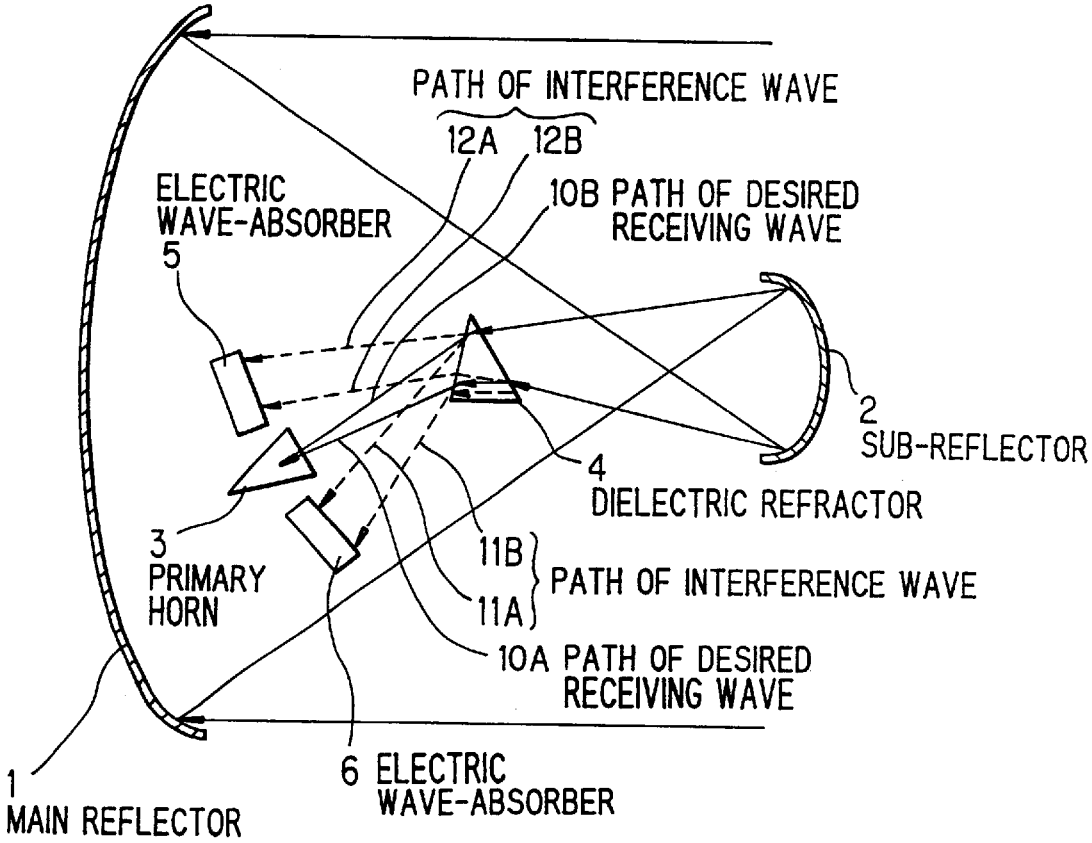
FIG. 4 shows an antenna apparatus according to the second preferred embodiment of the invention.

FIG. 4 shows an antenna apparatus according to the second preferred embodiment of the invention. The antenna apparatus shown in FIG. 4 serves as a receiving antenna, and an electric wave incident on the antenna apparatus is finally received by a primary horn 3 via a main reflector 1, a sub-reflector 2, and a dielectric refractor 4. The antenna apparatus is composed of the main reflector 1, the sub-reflector 2, the primary horn 3 and the dielectric refractor 4. Although the arrangement of the structural elements is nearly the same as those of the first preferred embodiment, electric wave-absorbers 5 and 6 are respectively situated over and under the primary horn 3. Positions and attitudes of the primary horn 3 and the dielectric refractor 4 relative to the sub-reflector 2 are adjusted in consideration of a refractive index of the dielectric refractor 4 in a frequency band of a desired receiving wave so that the desired electric wave reflected by the sub-reflector 2 illuminates an aperture of the primary horn 3.

In FIG. 4, the electric wave propagated from the outside is reflected by the main reflector 1, reaches the sub-reflector 2 to be again reflected thereby, and reaches the dielectric refractor 4. The electric wave in the desired receiving frequency band (the desired wave) incident on the dielectric refractor 4 is refracted thereby so as to pass along a path 10A to 10B for the desired wave, and is received by the primary horn 3. On the other hand, when an interference wave outside the desired receiving frequency band is reflected by the sub-reflector 2, the reflected wave passes along a path different from 10A to 10B for the desired receiving wave. When a frequency of the interference wave is higher than that in the desired receiving frequency band, the refractive index of the dielectric refractor is larger, and the interference wave passes along a path 11A to 11B therefor. Then, the interference wave does not reach the primary horn 3 but the electric wave-absorber 6 situated under the primary horn 3. Similarly, when a frequency of the interference wave is lower than that in the desired receiving frequency band, the refractive index of the dielectric refractor is smaller, and the interference wave passes along a path 12A to 12B therefor. Then, the interference wave does not reach the primary horn 3 but the electric wave-absorber 5 situated over the primary horn 3.

As mentioned in the above, according to the antenna apparatus shown-in FIG. 4, since only the electric wave in the desired receiving frequency band reaches the primary horn 3 and the interference wave is absorbed by the electric wave-absorbers 5, 6, the interference wave can be suppressed.

In the aforementioned embodiments, although the explanations are given on the case of the Gregorian reflector antenna having a concave sub-reflector, the application of the invention is never restricted to the Gregorian reflector antenna and a similar effect can be obtained when the invention is applied to a Cassegrain reflector antenna having a convex sub-reflector.

Moreover, although the dielectric refractor having a prism like configuration with a triangular cross-section is used in the aforementioned embodiments, the dielectric refractor having a other configuration can be adopted so long as the undesired wave can be separated, and the dielectric refractor having a trapezoidal cross-section can be used for instance.

As mentioned in the above, in the antenna apparatus according to the invention, since the dielectric refractor, the refractive index of which varies in accordance with the frequency, is situated between the primary horn and the sub-reflector, the undesired transmitting wave is refracted so as not to reach the sub-reflector or the interference wave is refracted so as not to reach the primary horn, and the undesired transmitting wave or the interference wave is absorbed by the electric wave-absorber. Accordingly, the undesired transmitting wave is prevented from being radiated to the outside of the antenna apparatus or the influence of the interference wave can be suppressed.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching here is set forth.

What is claimed is:

1. An antenna apparatus having a primary horn serving as an output source of an electric wave, a main reflector formed of a parabolic mirror for radiating said electric wave as a parallel beam in a predetermined direction, and a sub-reflector for reflecting said electric wave radiated from said primary horn to said main reflector, comprising:

a dielectric refractor which refracts said electric waves radiated from said primary horn so that a desired wave in a desired frequency band illuminates said sub-reflector, and an undesired wave outside said desired frequency band does not illuminate said sub-reflector, and electric wave-absorbers which are situated near an outer periphery of said sub-reflector, and absorb said undesired refracted wave outside said desired frequency band.

2. The antenna apparatus defined as claim 1, wherein:

said primary horn is situated under a principal axis of said main reflector and inclines to upside by a predetermined angle.

3. The antenna apparatus defined as claim 1, wherein:

said electric wave-absorbers are respectively situated over and under said sub-reflector.

4. An antenna apparatus having a main reflector formed of a parabolic mirror for receiving an electric wave propagated from a transmitting source, a sub-reflector for reflecting said electric wave reflected by said main reflector in a predetermined direction and a primary horn for receiving said electric wave reflected by said sub-reflector, comprising:

a dielectric refractor which refracts said electric waves reflected by said sub-reflector so that a desired wave in a desired frequency band illuminates an aperture of said primary horn, and an interference wave outside said desired frequency band does not illuminate said aperture of said primary horn, and electric wave-absorbers which are situated near an outer periphery of said primary horn and absorb said interference wave outside said desired frequency band refracted by said refractor.

5. The antenna apparatus defined as claim 4, wherein:

said primary horn is situated under a principal axis of said main reflector and inclines to upside by a predetermined angle.

6. The antenna apparatus defined as claim 4, wherein:

said electric wave-absorbers are respectively situated over and under of said primary horn.

* * * * *